United States Patent [19]

Isozumi

[11] Patent Number: 5,052,235

[45] Date of Patent: Oct. 1, 1991

[54] SPACED BEARING ARRANGEMENT FOR COAXIAL ENGINE STARTER

[75] Inventor: Shuzou Isozumi, Himeji, Japan

[73] Assignee: Mitsubishi Denki Kabushiki Kaisha, Tokyo, Japan

[21] Appl. No.: 493,543

[22] Filed: Mar. 14, 1990

[30] Foreign Application Priority Data

Mar. 15, 1989 [JP] Japan ..... 1-65220

[51] Int. Cl.[5] ..... F02N 11/00

[52] U.S. Cl. ..... 74/7 E; 74/6; 123/179 M; 290/48

[58] Field of Search ..... 74/6, 7 R, 7 E; 123/179 M; 290/48

[56] References Cited

U.S. PATENT DOCUMENTS

| | | | |
|---|---|---|---|
| 4,760,274 | 7/1988 | Isozumi | 290/48 |
| 4,816,712 | 3/1989 | Tanaka | 310/237 |
| 4,852,417 | 8/1989 | Tanaka | 74/7 E |
| 4,860,604 | 8/1989 | Kinoshita | 74/7 E |
| 4,907,464 | 3/1990 | Isozumi | 74/7 E X |
| 4,926,706 | 5/1990 | Isozumi | 74/7 E X |
| 4,945,777 | 8/1990 | Isozumi | 74/7 E |

FOREIGN PATENT DOCUMENTS

| | | | |
|---|---|---|---|
| 1311876 | 11/1962 | France . | |
| 64-83850 | 3/1989 | Japan | 290/48 |

*Primary Examiner*—Leslie A. Braun
*Assistant Examiner*—Scott Anchell
*Attorney, Agent, or Firm*—Sughrue, Mion, Zinn, Macpeak and Seas

[57] ABSTRACT

A coaxial engine starter comprising an electric motor having an armature rotary shaft 23, an output rotary shaft 5 axially slidably supported in an axial alignment relationship with the armature rotary shaft and a pinion 10 disposed on the front end of the output rotary shaft. The starter also comprises a planetary speed reduction gear 7 having a sun gear disposed on the armature rotary shaft, a plurality of planetary gears rotatable around the sun gear and a stationary internal gear engaging the planetary gear, and an over-running clutch 21 having a clutch outer member supporting the planetary gears and a clutch inner member slidably coupled to the output rotary shaft and having front and rear ends. The clutch inner member is rotatably supported at its front end by a first bearing 11 supported by the machine frame 8 and at its rear end by a second bearing 25 mounted on the armature rotary shaft in front of the sun gear of the planetary speed reduction gear.

6 Claims, 3 Drawing Sheets

SPACED BEARING ARRANGEMENT FOR COAXIAL ENGINE STARTER

BACKGROUND OF THE INVENTION

This invention relates to an engine starter and, more particularly, to a coaxial engine starter in which an output rotary shaft driven by an electric motor is axially slidable so that a pinion gear disposed on a front end of the output rotary shaft can be brought into engagement with an engine ring gear.

One example of a conventional coaxial engine starter for starting an internal combustion engine is disclosed in Japanese Kokai No. 63-90665. According to the conventional coaxial engine starter 1 shown in FIG. 1, a d.c. electric motor 2 has a hollow armature rotary shaft 3 and a solenoid switch 4 positioned at the rear end of the d.c. motor 2 and an output rotary shaft 5 coaxially disposed at the front end of the armature rotary shaft 3. The output rotary shaft 5 is axially slidably and rotatably supported by a bearing 6 disposed within the armature rotary shaft 3, whereby the output rotary shaft 5 can be pushed forward when the unillustrated push rod of the solenoid switch is actuated.

It is seen that a sun gear 7*a* is formed on the outer circumference of the front end of the armature rotary shaft 3 and a plurality of planetary gears 7*b* are in mesh with the sun gear 7*a*. These planetary gears 7*b* also mesh with an inner gear 7*c* formed in the inner circumferential surface of the front bracket 8 and are rotatably supported by shafts 7*d* secured on a carrier 7*e* which is an integral part of a clutch outer member 9*b* of an over-running clutch 9. The sun gear 7*a*, the planetary gears 7*b*, the inner gear 7*c*, the shafts 7*d* and the carrier 7*e* together constitute a planetary speed reduction gear 7 which reduces the rotational speed of the armature rotary shaft 3.

On the output rotary shaft 5, an over-running clutch 9 is mounted, of which clutch inner member 9*a* is engaged at its splines 9*d* with the output rotary shaft 5 by helical splines 5*a*, so that the output rotary shaft 5 is allowed to axially slide while being rotated by the clutch inner member 9*a*. A bearing 15 is disposed between the inner ends of the clutch inner and outer members. A compression spring 9*e* is disposed between the clutch inner member 9*a* and the splined portion 5*a* of the output rotary shaft 5. On the front end of the output rotary shaft 5, a pinion 10 which engages and disengages relative to an engine ring gear (not shown) is mounted by straight splines 10*a* formed in the inner circumference of the pinion 10 and splines 5*b* formed on the outer circumference of the output rotary shaft 5. A stopper 12 is mounted on the output rotary shaft 5 by a stop ring 13. A compression spring 14 is disposed between a step of the pinion 10 and a step portion of the output rotary shaft 5. When the output rotary shaft 5 is moved forward, the pinion 10 meshes with the engine ring gear (not shown) to rotate and start the engine.

In the coaxial engine starter 1 of the above construction, the over-running clutch 9 and the planetary speed reduction gear 7 are assembled into one unit through which the output rotary shaft 5 extends in an axially aligned relationship. This assembly of the over running clutch 9 and the planetary speed reduction gear 7 is supported only at the front end of the clutch inner member 9*a* which is simply inserted into the bearing 11 supported by the front bracket 8. Thus, since this assembly is supported in a cantilevered fashion, the rotary axes of the planetary gears 7*b* supported by the pins 7*d* secured to the carrier 7*e* integral with the clutch outer member 9*b* wobble or become eccentric, resulting in the generation of noise in the meshing gears, the generation of wear in the tooth meshing surfaces, and damage to the gears.

SUMMARY OF THE INVENTION

Accordingly, one of the objects of the present invention is to provide a coaxial engine starter free from the above-discussed problems.

Another object of the present invention is to provide a coaxial engine starter in which the components of the starter such as the armature rotary shaft, the output rotary shaft, the over-running clutch and the planetary speed reduction gear are precisely maintained in a coaxial relationship.

Another object of the present invention is to provide a coaxial engine starter in which the generation of noise is reduced.

A further object of the present invention is to provide a coaxial engine starter wherein wear and damages to the gear teeth are significantly decreased.

With the above objects in view, the coaxial engine starter of the present invention comprises an electric motor having an armature rotary shaft, an output rotary shaft axially slidably supported in an axial alignment relationship with the armature rotary shaft and a pinion disposed on the front end of the output rotary shaft. The starter also comprises a planetary speed reduction gear having a sun gear disposed on the armature rotary shaft, a plurality of planetary gears rotatable around the sun gear and a stationary internal gear engaging the planetary gears, and an over running clutch having a clutch outer member supporting the planetary gears and a clutch inner member slidably coupled to the output rotary shaft and having front and rear ends. The clutch inner member of the over-running clutch is rotatably supported at its front end by a first bearing supported by the machine frame and at its rear end by a second bearing mounted on the armature rotary shaft in front of the sun gear of the planetary speed reduction gear.

BRIEF DESCRIPTION OF THE DRAWINGS

The present invention will become more readily apparent from the following detailed description of the preferred embodiments of the present invention taken in conjunction with the accompanying drawings, in which.

DESCRIPTION OF THE PREFERRED EMBODIMENTS

Figure 1:
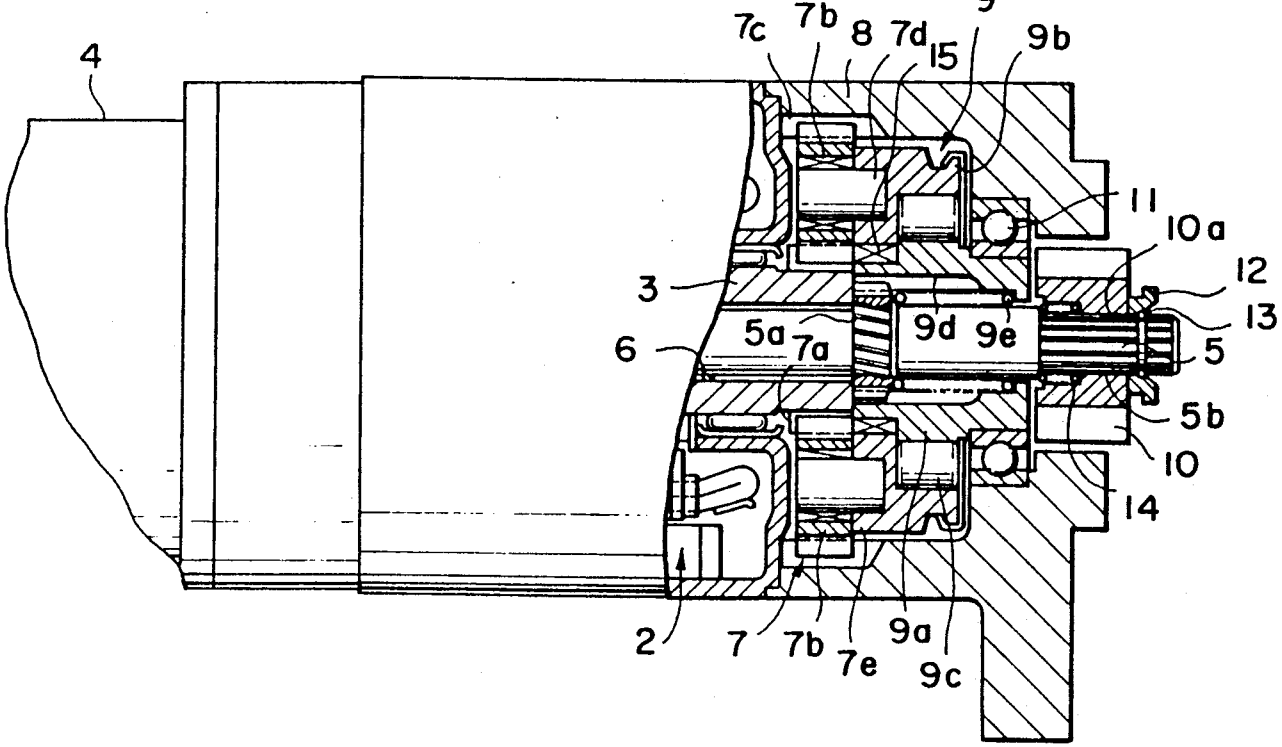
FIG. 1 PRIOR ART
FIG. 1 is a partial sectional front view of a conventional coaxial engine starter.
Figure 2:
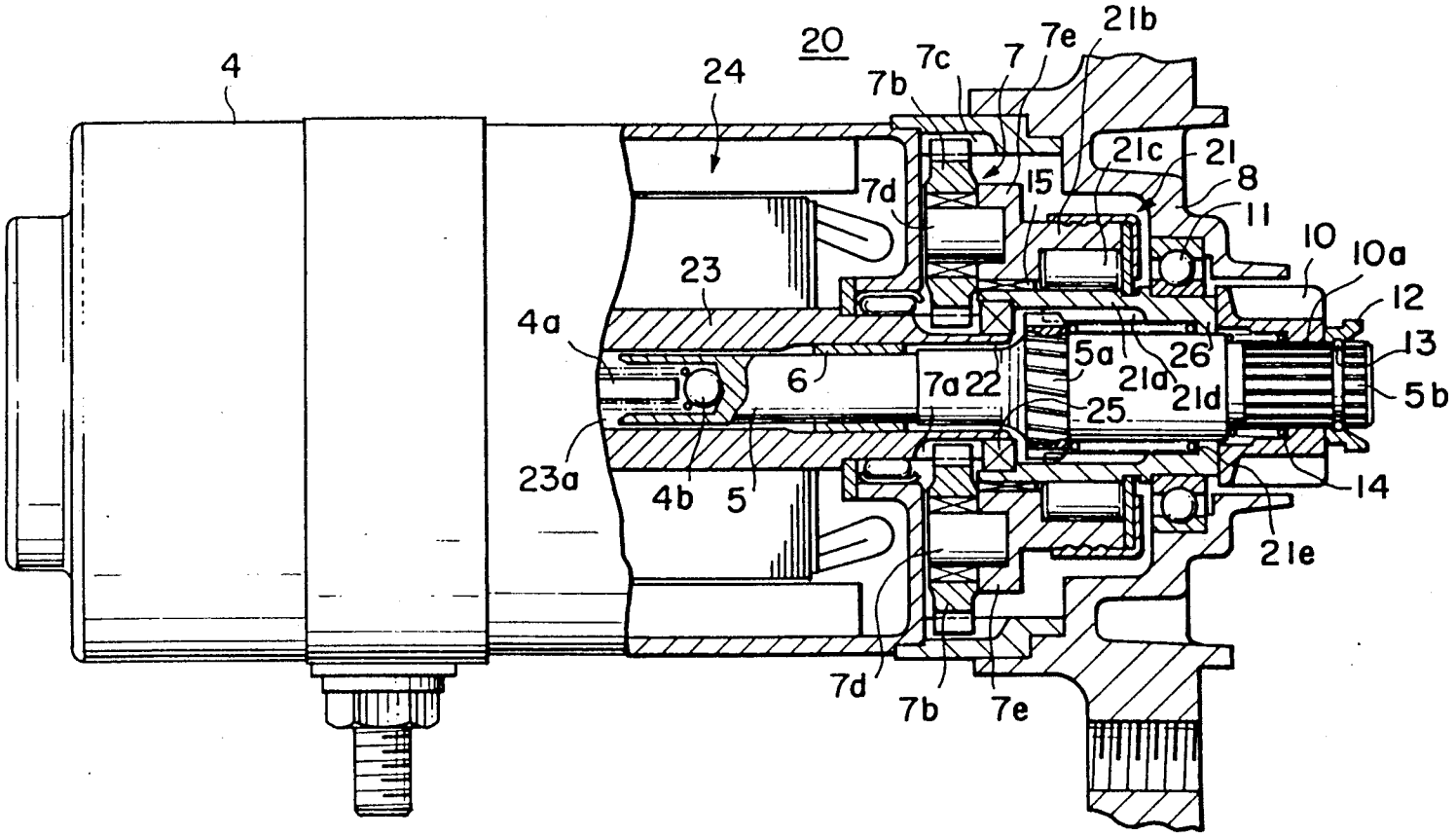
FIG. 2 is a partial sectional front view of the coaxial engine starter of one embodiment of the present invention.

In FIG. 2 in which one embodiment of the present invention is illustrated, a coaxial engine starter 20 comprises a d.c. electric motor 24 having a hollow armature rotary shaft 23 and a plunger rod 4*a* of a solenoid switch 4 positioned at the rear end of the d.c. motor 24 is inserted into an inner passage 23*a* of the armature rotary shaft 23 so that the inserted front end of the plunger rod 4a abuts against the rear end of an output rotary shaft 5 coaxially disposed at the front end of the armature rotary shaft 23 through a steel ball 4b. The output rotary shaft 5 is axially slidably and rotatably supported by a sleeve bearing 6 disposed within the inner passage 23a of the armature rotary shaft 23, whereby the output rotary shaft 5 can be pushed forward when the push rod 4a of the solenoid switch 4 is actuated.

It is seen that a sun gear 7a is formed on the outer circumference of the front end of the armature rotary shaft 23 and a plurality of planetary gears 7b are disposed in mesh with the sun gear 7a. These planetary gears 7b also mesh with an inner gear 7c formed in the inner circumferential surface of the front bracket 8 and ar rotatably supported by shafts 7d secured on a carrier 7e which is an integral part of a clutch outer member 21b of an over-running clutch 21. The sun gear 7a, the planetary gears 7b, the inner gear 7c, the shafts 7d and the carrier 7e together constitute a planetary speed reduction gear 7 which reduces the rotational speed of the armature rotary shaft 23.

On the output rotary shaft 5, an over-running clutch 21 is mounted, of which clutch inner member 21a is engaged at its splines 21d with the output rotary shaft 5 by helical splines 5a, so that the output rotary shaft 5 is allowed to axially slide while being rotated by the clutch inner member 21a. The front end of the clutch inner member 21a has an inwardly extending bearing surface 26 which slides on the outer cylindrical surface of the output rotary shaft 5. The rear end of the clutch inner member 21a extends rearwardly beyond the splined portion 5a of the output rotary shaft 5. The outer circumferential surface of the rear end of the clutch inner member 21a supports a bearing 12 for rotatably supporting the clutch outer member 21b, and the inner circumferential surface of the rear end of the clutch inner member 21a supports a bearing 25 mounted on the armature rotary shaft 23 at an end 22 thereof in front of the sun gear 7a of the planetary speed reduction gear 7 for rotatably supporting the rear end of the clutch inner member 21a of the over-running clutch 21.

A plurality of rollers 21c are disposed between the clutch inner and outer members 21a and 21b. A compression spring 21e is disposed between the bearing surface 26 of the clutch inner member 21a and the splined portion 5a of the output rotary shaft 5. On the front end of the output rotary shaft 5, a pinion 10 which engages and disengages relative to an engine ring gear (not shown) is mounted by straight splines 10a formed in the inner circumference of the pinion 10 and splines 5b formed on the outer circumference of the output rotary shaft 5. A stopper 12 is mounted on the output rotary shaft 5 by a stop ring 13. A compression spring 14 is disposed between a step of the pinion 10 and a step portion of the output rotary shaft 5. When the output rotary shaft 5 is moved forward, the pinion 10 meshes with the engine ring gear (not shown) to rotate and start the engine.

In the coaxial engine starter as above described, the clutch inner member 21a of the over-running clutch 21 is rotatably supported at its front end through the bearing 11 attached to the front bracket 8 and at its rear end through the bearing 25 on the armature rotary shaft 23. Therefore, the central axis of the planetary speed reduction gear 7 as well as the axis of the over-running clutch 21 can be precisely maintained in their axially aligned positions relative to each other and to output rotary shaft 5 and the armature rotary shaft 23. Further, the front end of the output rotary shaft 5 is supported by the bearing surface 26 formed at the front end of the clutch inner member 21a which is supported by the front bracket 8 through the bearing 11, and the rear end of the output rotary shaft 5 is supported by a sleeve bearing 6 mounted in the armature rotary shaft 23. The rotational axis of the output rotary shaft 5 is also precisely maintained in a coaxial relationship with the axes of other components, ensuring that the rotating components, i.e., the output rotary shaft 5, the clutch inner member 21a and the armature rotary shaft 23 are all kept in a precise coaxial relationship. Therefore, the various gears smoothly and properly mesh with each other without generating undesirable noise and wear or damage to the gear teeth.

Figure 3:
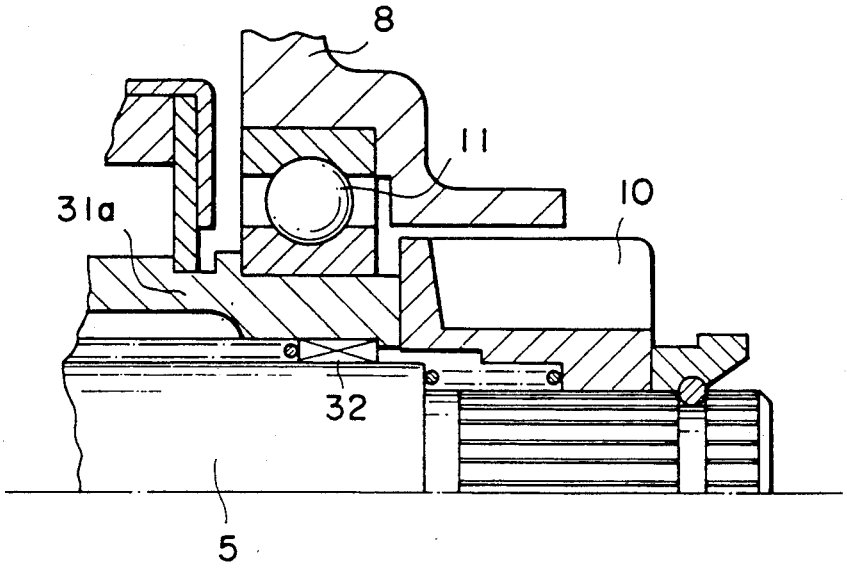
FIG. 3 is a partial sectional front view of the coaxial engine starter of another embodiment of the present invention.

FIG. 3 illustrates another embodiment of the coaxial engine starter of the present invention in which a clutch inner member 31a has a bearing 32 disposed between its front end and the output rotary shaft 5 in stead of the inwardly projecting bearing surface 26 illustrated in FIG. 2.

The pinion 10 may be integrally formed on the front end of the output rotary shaft 5. The bearing 15 disposed between the outer circumferential surface of the rear end of the clutch inner member 21a and the clutch outer member 21b may be omitted and can be supported by simple sliding bearing surfaces.

What is claimed is:

1. A coaxial engine starter, comprising:

a machine frame (8);

an electric motor having a hollow armature rotary shaft (23);

an output rotary shaft (5) axially slidably supported in said machine frame and said armature rotary shaft, disposed in axial alignment with said armature rotary shaft, and having a front end distal said electric motor and a rear end proximate said electric motor;

a pinion (10) disposed on said front end of said output rotary shaft;

a planetary speed reduction gear (7) having a sun gear disposed on said armature rotary shaft, a plurality of planetary gears rotatable around said sun gear and a stationary internal gear engaging said planetary gears;

an over-running clutch (21) having a clutch outer member supporting said planetary gears and a clutch inner member slidably coupled to said output rotary shaft and having front and rear ends respectively distal and proximate said electric motor;

first bearing means (11) supported by said machine frame for rotatably supporting said front end of said clutch inner member; and second bearing means (25) disposed on said armature rotary shaft in front of said sun gear of said planetary speed reduction gear for rotatably supporting said rear end of said clutch inner member of said over-running clutch.

2. A coaxial engine starter as claimed in claim 1, wherein said first bearing means supports an outer surface of said front end of said clutch inner member.

3. A coaxial engine starter as claimed in claim 1, wherein said second bearing means supports an inner circumferential surface of said rear end of said clutch inner member.

4. A coaxial engine starter as claimed in claim 1, further comprising third bearing means disposed on the inner surface of said front end of said clutch inner member for rotatably supporting said output rotary shaft.

5. A coaxial engine starter as claimed in claim 4, wherein said third bearing means is a bearing surface (26) integral with said clutch inner member.

6. A coaxial engine starter as claimed in claim 4, wherein said third bearing means is a bearing element (32) separate from said clutch inner member.

* * * * *